US009498406B2

(12) United States Patent
Donschietz et al.

(10) Patent No.: US 9,498,406 B2
(45) Date of Patent: Nov. 22, 2016

(54) CLINICAL TESTING BLINDING TUBES AND METHOD OF ASSEMBLY

(71) Applicant: Fisher Clinical Services, Inc., Allentown, PA (US)

(72) Inventors: Michael T. Donschietz, Allentown, PA (US); Kevin M. Matzen, Summit Hill, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 0 days.

(21) Appl. No.: 14/595,764

(22) Filed: Jan. 13, 2015

(65) Prior Publication Data

US 2016/0199256 A1 Jul. 14, 2016

(51) Int. Cl.

| | |
|---|---|
| ***A61J 1/16*** | (2006.01) |
| ***A61J 1/14*** | (2006.01) |
| ***B65D 35/24*** | (2006.01) |
| ***B65D 35/44*** | (2006.01) |
| ***B65D 35/00*** | (2006.01) |

(52) U.S. Cl.

CPC ..... *A61J 1/16* (2013.01); *A61J 1/1412* (2013.01); *B65D 35/00* (2013.01); *B65D 35/24* (2013.01); *B65D 35/44* (2013.01); *A61J 2001/1418* (2013.01)

(58) Field of Classification Search

CPC .. A61J 1/1412; A61J 1/16; A61J 2001/1418; B65D 35/24; B65D 35/44; B65D 35/00; B65D 77/06; B65D 83/0055

IPC ..... B65D 35/24, 35/44, 35/00, 77/06, B65D 83/0055

See application file for complete search history.

(56) References Cited

U.S. PATENT DOCUMENTS

| | | | | |
|---|---|---|---|---|
| 2,535,671 A * | 12/1950 | Cutler | ..... | B65D 35/24 222/105 |
| 3,022,920 A * | 2/1962 | Croom, Jr. | ..... | B65D 35/24 222/105 |
| 3,269,604 A * | 8/1966 | Serry | ..... | B65D 35/24 222/105 |

(Continued)

FOREIGN PATENT DOCUMENTS

| | | |
|---|---|---|
| DE | 24 00 476 A1 | 7/1975 |
| KR | 2009-0085732 A | 8/2009 |

(Continued)

OTHER PUBLICATIONS

International Search Report and Written Opinion dated Apr. 22, 2016, issued in PCT Application No. PCT/US2016/012341, filed Jan. 6, 2016.

*Primary Examiner* — Frederick C Nicolas
*Assistant Examiner* — Bob Zadeh
(74) *Attorney, Agent, or Firm* — Workman Nydegger

(57) ABSTRACT

A blinding tube assembly for concealing a drug delivery tube includes a blinding tube having a tubular sleeve that bounds a compartment and a tubular dispersing stem projecting from an end of the sleeve. A drug delivery tube is inserted into the compartment through and access opening opposite the dispersing stem. The drug delivery tube has a tubular body and a dispensing stem extending from a drug delivery end thereof. A tubular bushing is disposed about the dispensing stem such that when the drug delivery tube is inserted, the dispensing stem is received into the dispersing stem of the blinding tube with the bushing disposed therebetween. An annular end face of the dispensing stem is not visible through a dispersing opening in the dispersing stem from outside the blinding tube.

14 Claims, 10 Drawing Sheets

(56) References Cited

U.S. PATENT DOCUMENTS 3,724,722 A * 4/1973 Ballo ..... B65D 35/10 222/105
6,206,244 B1 * 3/2001 Muhlbauer ..... B05C 17/00576 222/105
7,913,876 B2 * 3/2011 Muenzenberger ... B65D 81/325 206/219
2003/0015549 A1 * 1/2003 Yoshida ..... B65D 35/14 222/103

FOREIGN PATENT DOCUMENTS

KR 2010-0041369 A 4/2014
KR 10-1468408 12/2014

* cited by examiner

CLINICAL TESTING BLINDING TUBES AND METHOD OF ASSEMBLY

CROSS-REFERENCE TO RELATED APPLICATIONS

Not applicable

BACKGROUND OF THE INVENTION

1. The Field of the Invention

The present invention relates to blinding tubes for clinical testing and related methods of assembly.

2. The Relevant Technology

An increasing number of pharmaceutical drugs are disposed in tubes and dispensed therefrom during use. Clinical trials for such tube-disposed pharmaceutical drugs require that the drug dosage be delivered in a blinded study. As part of the clinical trial protocols, outer markings can be removed from the tube or covered prior to administering the drug dosage. For instance, adhesive product labels can be peeled from the exterior of the tube leaving only the tubular container in which the drug dosage is disposed. Alternatively, the drug-containing tube can be wrapped in blinding tape or other material to cover the label or markings. Accordingly, the drug administering technician or recipient are blind as to the identity of the drug, the concentration thereof, or other characteristic being studied that may be reported on the label. The technician or recipient then simply dispenses the drug dosage from the covered tube.

In some cases, the tube includes identifying characteristics other than the written label. For instance, various tubes have unique shapes, sizes, colors, spouts, and other distinguishing features. The technician or recipient may not be blind as to these features by simply removing or covering the label of the tube. In particular, when comparing two different drugs, even slight differences between the tubes can lead the technician or recipient to believe that the respective drugs disposed therein are different. Controlling such perceived differences can be vital to the efficacy and fidelity of the clinical trial.

One way to overcome the appearance of these and other distinguishing features is to first dispense the drug dosage from the original tube into a standard, unmarked tube. All compared drugs in the trial are similarly squeezed from their sealed, manufacture tube into identical blinding tubes prior to proceeding with the trial. The drug can then be dispersed from the blinding tube, substantially preventing identification by the patient or technician. However, such transferring of a drug dosage can introduce a variety of variables that the clinical trial protocols seek to avoid. For instance, contamination, dosage alterations, and other undesirable consequences can result from squeezing the drug dosage from the first tube into the blinding tube prior to use. In addition, drug transfer can be costly, time-consuming, and annoying for drug administers.

Accordingly, what is needed in the art are blinding tubes and assemblies that overcome all or some of the above shortcomings.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
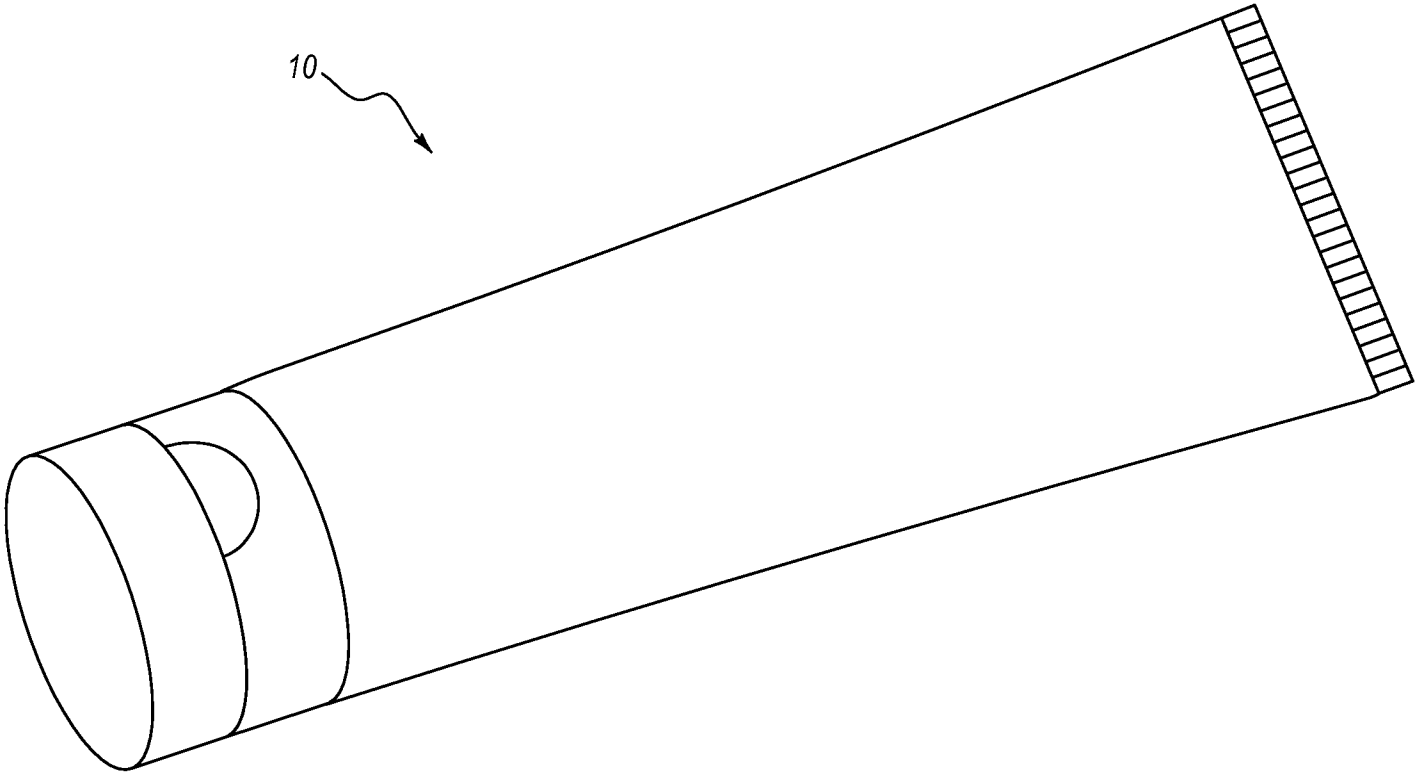
FIG. 1 is a perspective view of a sealed blinding tube assembly incorporating features of the present invention.

Before describing the present disclosure in detail, it is to be understood that this disclosure is not limited to particularly exemplified apparatus, systems, methods, or process parameters that may, of course, vary. It is also to be understood that the terminology used herein is only for the purpose of describing particular embodiments of the present disclosure, and is not intended to limit the scope of the invention.

All publications, patents, and patent applications cited herein, whether supra or infra, are hereby incorporated by reference in their entirety to the same extent as if each individual publication, patent, or patent application was specifically and individually indicated to be incorporated by reference.

The term "comprising" which is synonymous with "including," "containing," "having" or "characterized by," is inclusive or open-ended and does not exclude additional, unrecited elements or method steps.

It will be noted that, as used in this specification and the appended claims, the singular forms "a," "an" and "the" include plural referents unless the content clearly dictates otherwise. Thus, for example, reference to a "port" includes one, two, or more ports.

As used in the specification and appended claims, directional terms, such as "top," "bottom," "left," "right," "up," "down," "upper," "lower," "inner," "outer," "internal," "external," "interior," "exterior," "proximal," "distal" and the like are used herein solely to indicate relative directions and are not otherwise intended to limit the scope of the invention or claims.

Where possible, like numbering of elements have been used in various figures. Furthermore, alternative configurations of a particular element may each include separate letters appended to the element number. Accordingly, an appended letter can be used to designate an alternative design, structure, function, implementation, and/or embodiment of an element or feature without an appended letter. For instance, an element "80" may be embodied in an alternative configuration and designated "80*a*." Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element.

Various aspects of the present devices, systems, and methods may be illustrated with reference to one or more exemplary embodiments. As used herein, the term "embodiment" means "serving as an example, instance, or illustration," and should not necessarily be construed as preferred or advantageous over other embodiments disclosed herein.

Various aspects of the present devices and systems may be illustrated by describing components that are coupled, attached, and/or joined together. As used herein, the terms "coupled", "attached", "connected" and/or "joined" are used to indicate either a direct connection between two components or, where appropriate, an indirect connection to one another through intervening or intermediate components. In contrast, when a component is referred to as being "directly coupled", "directly attached", "directly connected" and/or "directly joined" to another component, there are no intervening elements present.

Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

In general, the present invention is directed to blinding tubes and blinding tube assemblies that are designed to receive a drug delivery tube having a drug dosage disposed therein. The blinding tubes and assemblies are configured so that when the drug delivery tube is disposed and optionally sealed therein, a drug recipient or administering technician does not visually perceive the drug delivery tube or any identifying, distinguishing features thereof. In addition, the drug dosage need not be dispensed from the drug delivery tube into the blinding tube prior to use. Instead, the drug dosage is dispensed and dispersed (e.g., simultaneously and/or sequentially) from the drug delivery tube and from the blinding tube, respectively, at the time of use or administration thereof.

Blinding Tube Assembly

Figure 2:
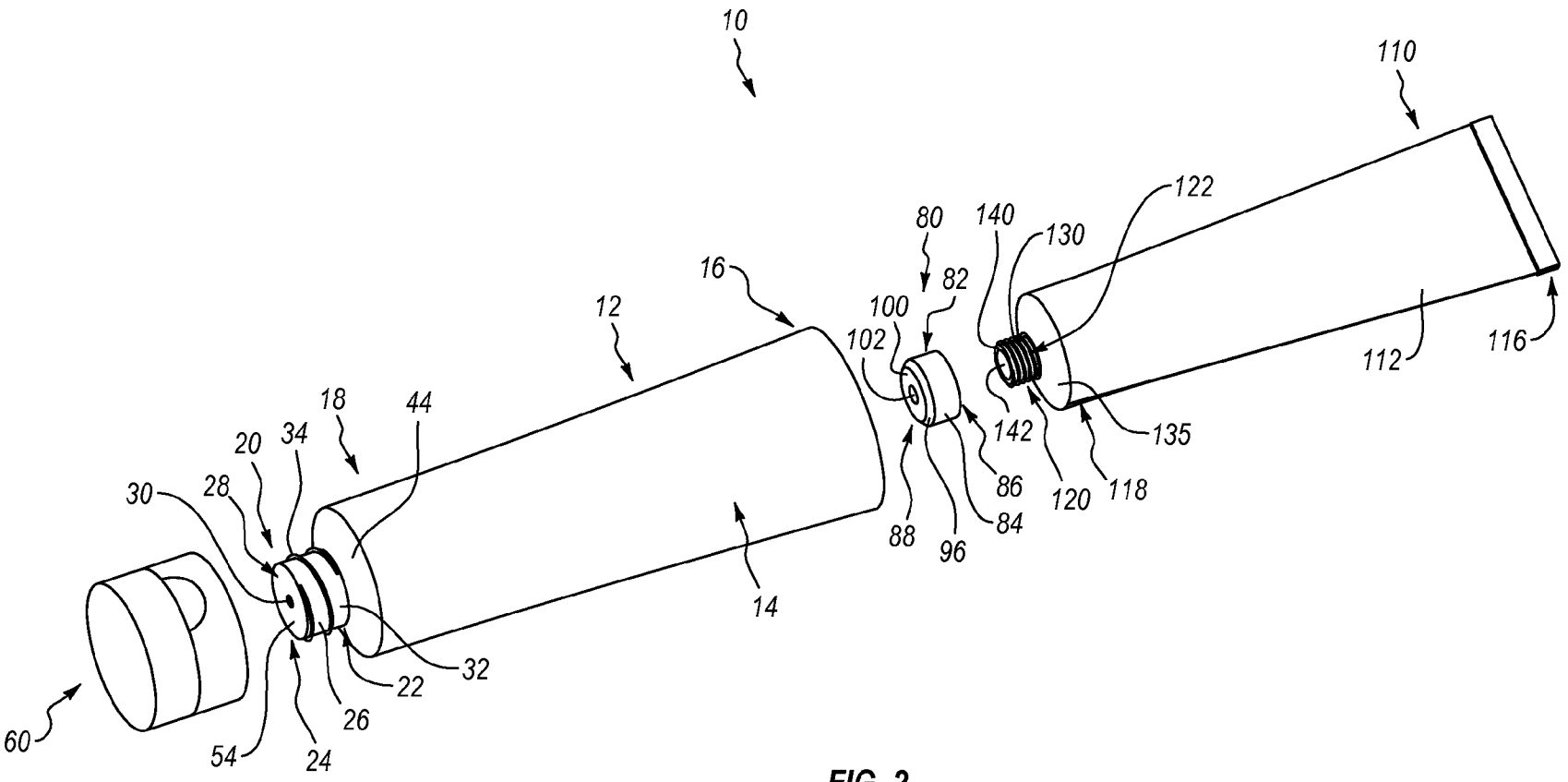
FIG. 2 is a partially exploded view of the unsealed blinding tube assembly depicted in FIG. 1.

Depicted in FIG. 1 is one embodiment of a blinding tube assembly 10 incorporating features of the present invention. As depicted in FIG. 2, blinding tube assembly 10 comprises a blinding tube 12, a cap 60 that removably connects to blinding tube 12, a drug delivery tube 110 that is received within blinding tube 12, and a bushing 80 that couples drug delivery tube 110 to blinding tube 12. The above elements will now be discussed in greater detail.

Figure 3:
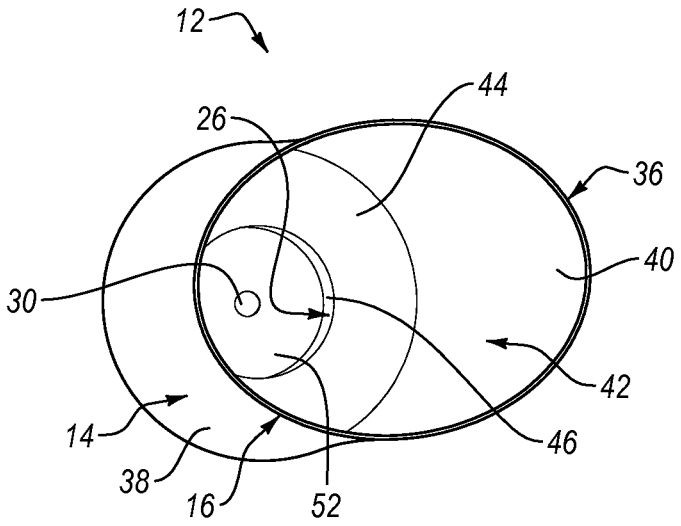
FIG. 3 is a rear perspective view of the blinding tube of the blinding tube assembly depicted in FIG. 2.
Figure 6:
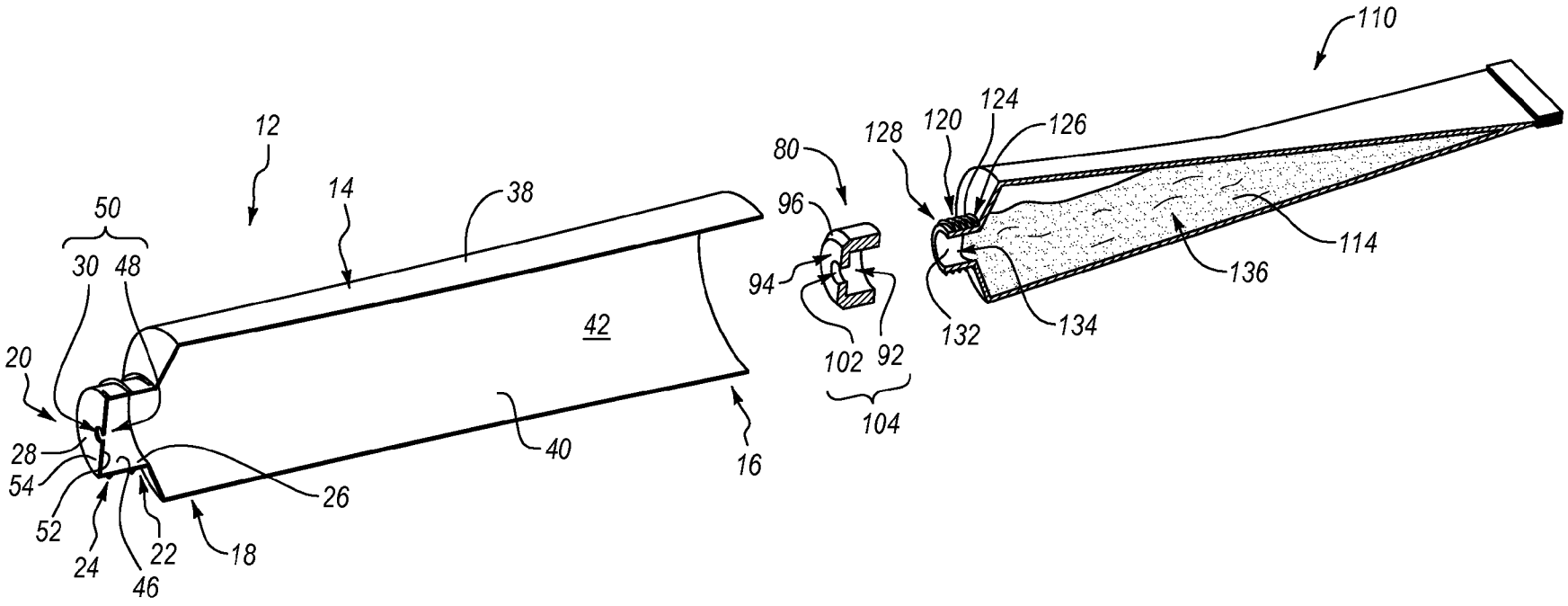
FIG. 6 is a cross-sectional perspective view of the blinding tube, bushing, and drug delivery tube of the blinding tube assembly depicted in FIG. 2.

As depicted in FIGS. 3 and 6, blinding tube 12 comprises a tubular sleeve 14 having an exterior surface 38 and an interior surface 40 that longitudinally extend between a first end 16 and an opposing second end 18. Interior surface 40 bounds a compartment 42. An access opening 36 (FIG. 3) is formed at first end 16 and communicates with compartment 42. In at least one embodiment, tubular sleeve 14 can have a generally rounded, circular, and/or oval transverse cross-sectional configuration. In some embodiments, tubular sleeve 14 can be configured to receive and/or conform to the specific shape of drug delivery tube 110. Thus, tubular sleeve 14 can comprise a generally circular cross-sectional shape and can adopt and/or conform to the contours or exterior shape of drug delivery tube 110 when drug delivery tube 110 is received therein (See e.g., FIGS. 7B and 7C).

Tubular sleeve 14 can have any suitable size, shape, and/or configuration. For instance, tubular sleeve 14 can have a diameter and/or cross-sectional width of greater than, less than, and/or about 15 mm, 20 mm, 25 mm, 30 mm, 35 mm, 40 mm, 50 mm, 60 mm, or more. In addition, tubular sleeve 14 can have a longitudinal length of greater than, less than, and/or about 2.5 cm, 5 cm, 7.5 cm, 10 cm, 15 cm, 20 cm, 25 cm, or more. In other embodiments, the diameter and length can be between any of the above two respective dimensions.

As depicted in FIG. 2, blinding tube 12 further comprises a tubular dispersing stem 20 disposed at second end 18 of sleeve 14. Dispersing stem 20 comprises an annular sidewall 26 having an exterior surface 32 extending between a first end 22 and an opposing second end 24 thereof. An annular shoulder 44 radially outwardly extends from second end 18 of sleeve 14 to first end 22 of dispersing stem 20. One or more helical threads 34 are formed and encircle on exterior surface 32. As depicted in FIG. 6, sidewall 26 of dispersing stem 20 also has an interior surface 46 that bounds a channel 48 extending between opposing ends 22 and 24.

Dispersing stem 20 can have any suitable size, shape, and/or configuration. For instance, dispersing stem 20 can have a generally rounded, circular, and/or oval transverse cross-sectional configuration. Dispersing stem 20 can have a diameter, cross-sectional width, and/or longitudinal length of greater than, less than, and/or about 2 mm, 2.5 mm, 3 mm, 3.5 mm, 4 mm, 4.5 mm, 5 mm, 6 mm, 7 mm, 10 mm, 12 mm, 15 mm, 18 mm, 20 mm, 25 mm, 30 mm, 35 mm, 40 mm, 45 mm, 50 mm, or more. With continued reference to FIG. 6, dispersing stem 20 also includes a terminal end face 28 disposed at second end 24 and extending radially inward from sidewall 26. Terminal end face 28 has an inner surface 52 (FIG. 3) facing inward toward channel 48 of dispersing stem 20 and an outer surface 54 facing outward away from channel 48. A dispersing opening 30 is encircled by and centrally extends through terminal end face 28. Dispersing opening 30 and channel 48 combine to form a passage 50 that extends through dispersing stem 20 and is in fluid communication with compartment 42 of tubular sleeve 14.

Blinding tube 12 or select components thereof can be comprised any suitable material, including polymeric, metal, such as aluminum, and/or other synthetic(s) or natural material(s). For instance, blinding tube 12 and/or tubular sleeve 14 can be comprised of a flexible material adapted to be rolled, collapsed, compressed, and/or conformational changed. Tubular sleeve 14 can alternatively comprise a semi-rigid material. Dispersing stem 20 can comprise a flexible, rigid, or semi-rigid material. For instance, dispersing stem 20 can comprise a semi-rigid plastic. As discussed below, in some embodiments dispersing stem 20 can be configured to receive dispensing stem 120 of drug delivery tube 110 therein (e.g., without significant alternation of the shape of dispersing stem 20).

Figure 5:
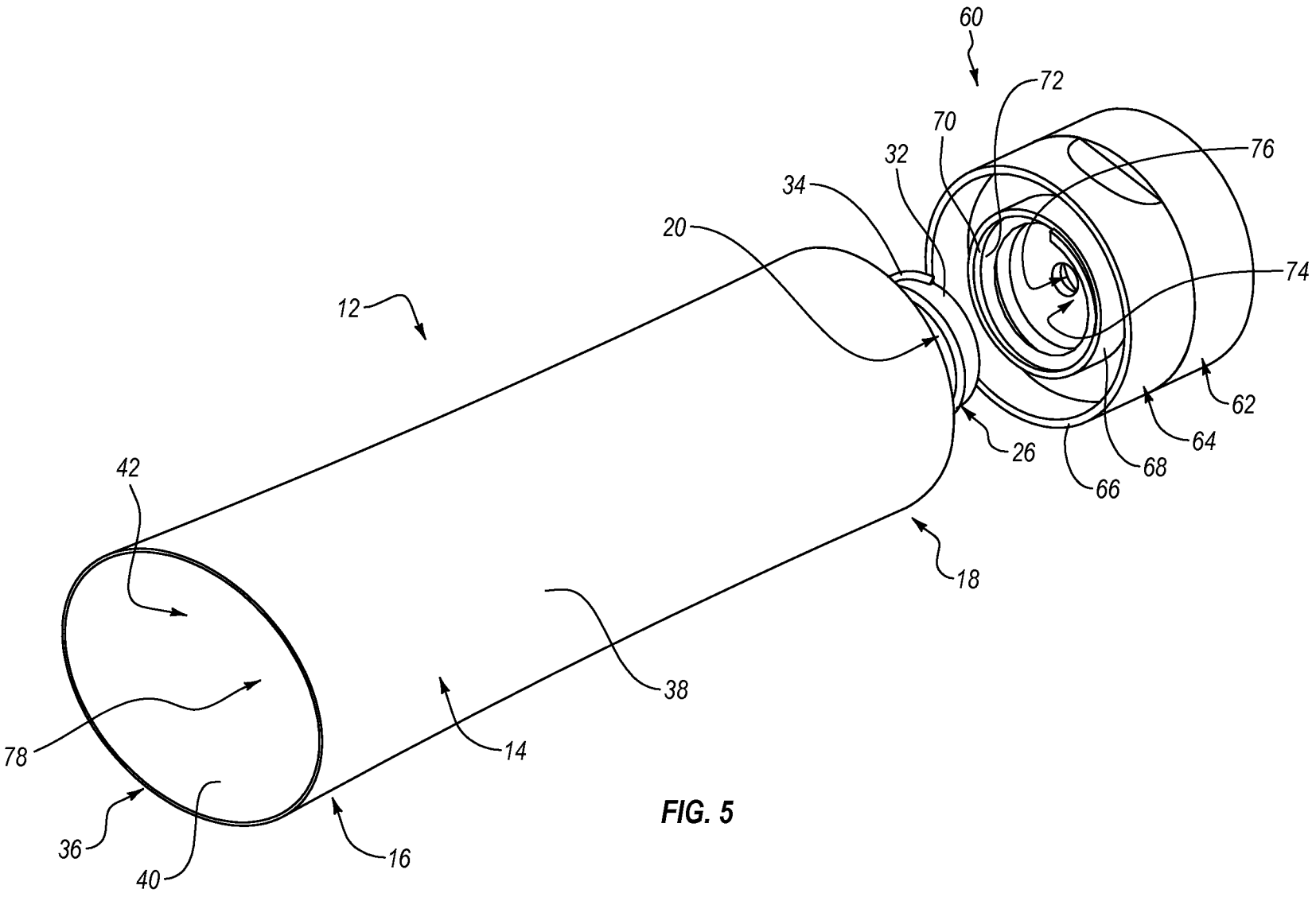
FIG. 5 is a rear perspective view of the blinding tube and cap of the blinding tube assembly depicted in FIG. 2.

Turning now to FIG. 5, cap 60 comprises a body 64 having an annular outer wall 66 encircling a concentrically disposed an annular inner wall 68, outer wall 66 and inner wall 68 each extending from an end face 74 Inner wall 68 has an inner surface 70 with one or more helical threads 72 formed thereon and configured to be threadedly coupled with helical threads 34 disposed on exterior surface 32 of dispersing stem 20. An opening 76 is encircled by and centrally extends through end face 74. Opening 76 is aligned with dispersing opening 30 (FIG. 2) of dispersing stem 20 upon coupling of helical threads 72 of cap 60 with helical threads 34 of dispersing stem 20. Accordingly, a fluid flow path 78 can extend from access opening 36 of blinding tube 12, through compartment 42 of tubular sleeve 14, through passage 50 (FIG. 6) of dispersing stem 20, and through opening 76 of cap 60. Cap 60 further comprises an optional lid 62 hingedly connected to body 64 and adapted to flip open to exposed opening 76 or flip closed to cover opening 76. In other embodiments, cap 60 can be replaced with other conventional caps such as a standard screw on cap that does not flip open.

Figure 4:
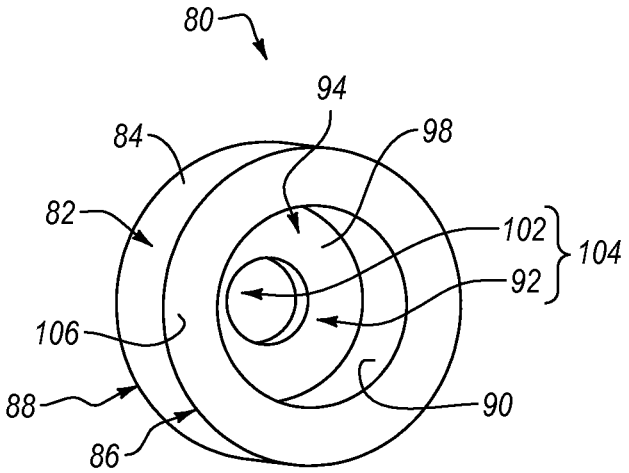
FIG. 4 is a rear perspective view of the bushing of the blinding tube assembly depicted in FIG. 2.

As depicted in FIG. 4, bushing 80 comprises a tubular body 82 having an exterior surface 84 that extends longitudinally between a first end 86 and an opposing second end 88. Tubular body 82 also has an interior surface 90 that bounds a cavity 92 extending between opposing ends 86 and 88. Bushing 80, tubular body 82, and other components thereof can comprise any suitable material including a rigid, flexible, elastomeric, or other material, and can comprise a plastic, polymer, metal, metal alloy, or other suitable material. Bushing 80 further comprises an annular rear end face 106 disposed at first end 86 and an annular flange 94 disposed at second end 88. Flange 94 extends radially inward from tubular body 82 and has an inner surface 98 facing inward toward cavity 92 of tubular body 82 and an outer surface 100 (FIG. 2) facing outward away from cavity 92. A transfer opening 102 is encircled by and centrally extends through annular flange 94. Cavity 92 and transfer opening 102 combined to form a throughway 104 that extends through tubular bushing 80. As depicted in FIG. 2, an optional chamfered edge 96 can be formed at the intersection between tubular body 82 and flange 94.

As depicted in FIGS. 2 and 6, drug delivery tube 110 comprises a tubular body 112 extending between a first end 116 and an opposing second end 118 and bounding a compartment 136 having a dosage 114 disposed therein. Dosage 114 can include a cream, ointment, paste, gel, liquid, solution, mixture, powder, or other suitable component and can comprise one or more active or inactive ingredients, including a test drug, a comparable drug, a placebo, a blank, a control, or any other suitable component. First end 116 is sealed closed such as by crimping, welding, or folding second end 118 of body 112. Other methods of sealing first end 116 can also be used.

Drug delivery tube 110 further comprises a tubular dispensing stem 120 disposed at and extending from second end 118 of tubular body 112. Dispensing stem 120 comprises an annular sidewall 122 having an exterior surface 124 extending between a first end 126 and an opposing second end 128 thereof. One or more helical threads 130 are formed on exterior surface 124. Sidewall 122 of dispensing stem 120 also has an interior surface 132 that bounds a channel 134 extending between opposing ends 126 and 128. An annular shoulder 135 radially outwardly extends from second end 118 of tubular body 112 to first end 126 of Dispensing stem 120 terminates at an annular end face 140 disposed at second end 128. A dispensing opening 142, which is the opening to channel 134, is encircled by and centrally extends through annular end face 140. Channel 134 is in fluid communication with compartment 136 such that dosage 114 can be dispensed from compartment 136 of tubular body 112, through channel 134 of dispensing stem 120, and out dispensing opening 142.

Methods of Assembling

Figure 7A:
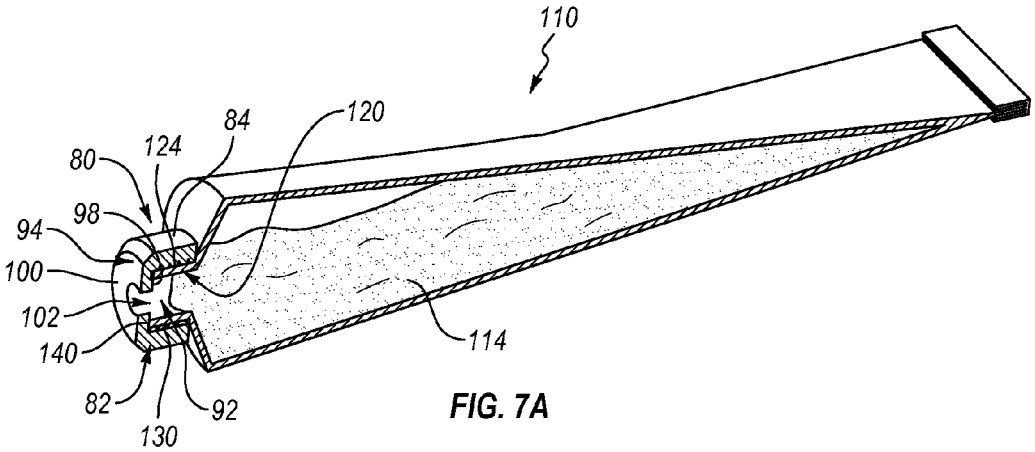
FIGS. 7A-7C are cross-sectional perspective views of the blinding tube assembly depicted in FIG. 2 at different stages of assembly.

Exemplary methods of assembling blinding tube assembly 10 will now be described. In one embodiment, tubular bushing 80 is initially mated with drug delivery tube 110. For instance, as depicted in FIG. 7A, dispensing stem 120 of drug delivery tube 110 can be inserted into cavity 92 of bushing 80. Accordingly, bushing 80 and/or cavity 92 thereof can be sized appropriately to receive dispensing stem 120 of drug delivery tube 110. Specifically, dispensing stem 120 of drug delivery tube 110 can be inserted into cavity 92 of bushing 80 such that exterior surface 124 of dispensing stem 120 and/or helical threads 130 (FIG. 2) disposed thereon engage against inner surface 90 (FIG. 4) of tubular bushing 80 such as by friction fit, press fit, or threaded engagement. With continued reference to FIGS. 2 and 4, tubular body 82, and/or inner surface 90 thereof of bushing 80 can comprise an elastomeric material configured to resiliently engage with helical threads 130 and become removably secured and/or attached thereto. In an alternative embodiment, inner surface 90 of bushing 80 can have one or more helical threads (not shown) formed thereon and configured to threadedly couple with helical threads 130 of dispensing stem 120. Accordingly, bushing 80 can be threadedly attached to dispensing stem 120 of drug delivery tube 110.

Returning now to FIG. 7A, dispensing stem 120 of drug delivery tube 110 is typically inserted into cavity 92 of bushing 80 until terminal end face 140 (FIG. 2) of dispensing stem 120 abuts inner surface 98 (FIG. 4) of flange 94 of bushing 80. In other embodiment, terminal end face 140 or drug delivery tube 110 does not directly abut flange 94 but is aligned with flange 94 so as to be (substantially and/or completely) covered thereby when viewed through transfer opening 102. Transfer opening 102 (FIG. 4) extending through flange 94 of bushing 80 is typically aligned with dispensing opening 142 (FIG. 2) of dispensing stem 120 of drug delivery tube 110 so that dosage 114 being dispensed out of dispensing stem 120 passes through transfer opening 102. In addition, dispensing opening 142 is not visible through passage 50 and/or transfer opening 102 thereof from outside the blinding tube 12 when bushing 80 is coupled with dispensing stem 120 of drug delivery tube 110.

Figure 7B:
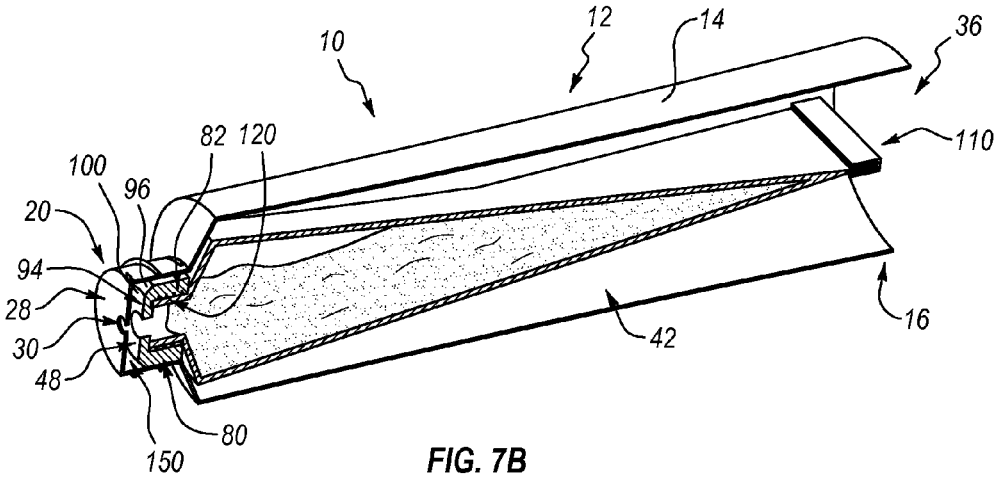
Figure 7C:
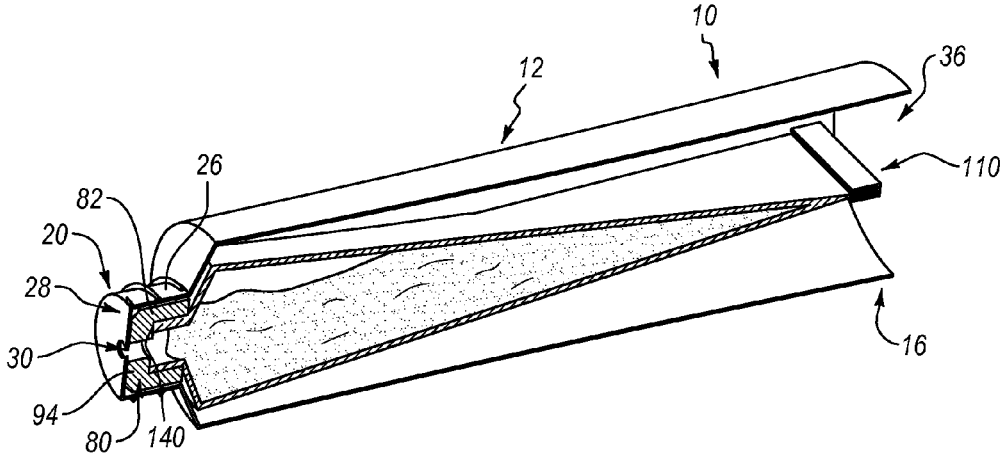

As illustrated in FIGS. 7B and 7C, the method can further include inserting second end 118 (FIG. 2) of drug delivery tube 110 having bushing 80 disposed thereon into compartment 42 of blinding tube 12 (through access opening 36 at first end 16 of tubular sleeve 14 of blinding tube 12). The coupled drug delivery tube 110 and bushing 80 (assembly) is then advanced within compartment 42 until bushing 80 and dispensing stem 120 are received into channel 48 of dispersing stem 20 of blinding tube 12. The optional chamfered edge 96 on bushing 80 can assist with centering and inserting bushing 80 into channel 48.

As illustrated in FIG. 7C, outer surface 100 (FIG. 7A) of flange 94 disposed at second end 88 (FIG. 2) of bushing 80 can abut interior surface 52 (FIG. 3) of terminal end face 28 disposed at second end 24 (FIG. 2) of dispersing stem 20. Dispersing opening 20 can be smaller than or equal to the size of transfer opening 102 of bushing 80 and is aligned therewith. Accordingly, neither outer surface 100 of flange 94 of bushing 80 nor end face 140 (FIG. 2) of drug delivery tube 110 are visible through dispersing opening 30 from outside the blinding tube 12 when drug delivery tube 110 is fitted within blinding tube 12. Alternatively, as illustrated in FIG. 7B, a gap 150 can be disposed between outer surface 100 of flange 94 and interior surface 52 of terminal end face 28. In another embodiment, dispersing opening 20 can be larger than the size of transfer opening 102 of bushing 80. In these embodiments, it will be appreciated that while flange 94 of bushing 80 may be visible through dispersing opening 30 from at least one vantage point outside blinding tube 12, terminal end face 140 of drug delivery tube 110 is still not visible through dispersing opening 30 from outside blinding tube 12 when drug delivery tube 110 is fitted within blinding tube 12 due to end face 140 being covered by bushing 80. Thus, the entirety of the exterior surface of drug delivery tube 110, including terminal end face 140 thereof, can be completely concealed within blinding tube 12. Accordingly (and advantageously), a drug administering technician or recipient is blind as to the identity or identifying characteristics of or on drug delivery tube 110.

With continued reference to FIGS. 7A-7C, in at least one embodiment, tubular bushing 80 and/or tubular body 82 thereof can engage (e.g., fit snugly within) blinding tube 12, dispersing stem 20, and/or channel 48 thereof. For instance, bushing 80 can comprise an elastomeric material that creates a pressure fit between outer surface 84 of tubular body 82 of bushing 80 and inner surface 46 (FIG. 3) of annular sidewall 26 of dispersing stem 20. Thus, dispensing stem 120 of drug delivery tube 110 can be retained within channel 48 of dispersing stem 20 of blinding tube 12 by securing bushing 80 to dispensing stem 120 and by securing bushing 80 within dispersing stem 20. In one embodiment, dispensing stem 120 of drug delivery tube 110 is retained within channel 48 of dispersing stem 20 by closing access opening 36 at first end 16 of tubular sleeve 14 such that drug delivery tube 110 cannot retract within compartment 42.

Access opening 36 can be closed by crimping, rolling, clamping, sealing, welding, adhering, or any other appropriate means for closing blinding tube 12, tubular sleeve 14, and/or access opening 36 thereof. For instance, first end 16 (FIG. 2) of blinding tube 12 of blinding tube assembly 10 can be crimped and/or sealed closed, as illustrated in FIG. 1. The closing of access opening 36 not only assists in blinding drug delivery tube 110 but, as noted above, can also assist in retaining dispensing stem 120 of drug delivery tube 110 within cavity 92 of bushing 80 and retaining bushing 80 within into compartment 42 of blinding tube 12. That is, the closing of access opening 36 can prevent dispensing stem 120 from backing out of bushing 80 and prevent bushing 80 from backing out of compartment 42 of blinding tube 12.

Figure 8:
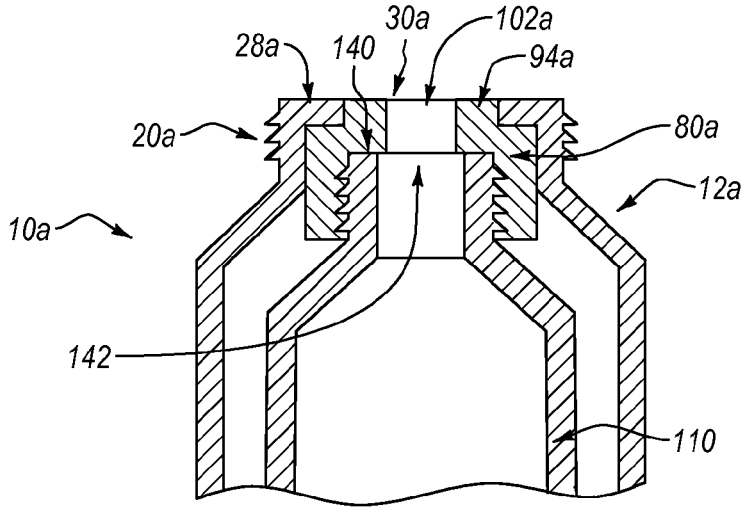
FIG. 8 is a cross-sectional top view of an alternative embodiment of a blinding tube assembly incorporating features of the present invention.

Cap 60 (FIG. 5) can then be attached to blinding tube 12. For instance, inner helical threads 72 of cap 60 can be threadedly coupled with outer helical threads 34 disposed on dispersing stem 20 of blinding tube 12. In an alternative embodiment, cap can be snapped-fitted, pressure-fitted, lock-fitted, or otherwise attached to blinding tube 12 or dispersing stem 20 thereof FIGS. 8 through 13 illustrate alternative embodiments of blinding tube assembly 10 designated as blinding tube assemblies 10*a*, 10*b*, 10*c*, 10*d*, 10*e*, and 10*f*, respectively. Like elements between blinding tube 12 and bushing 80 and the blinding tubes and bushing discussed in the below alternative embodiments are identified by like reference characters except that the reference characters for alternative embodiments include an accompanying letter corresponding to the embodiment. Blinding tube assemblies 10*a*, 10*b*, and 10*c* are configured identical or substantially similar to blinding tube assembly 10 (FIGS. 7B-7C) with the one or more notable differences. For instance, as illustrated in FIG. 8, blinding tube assembly 10*a* comprises a blinding tube 12*a* having a bushing 80*a* and drug delivery tube 110 disposed therein. In contrast to blinding tube 12 (FIG. 6), blinding tube 12*a* comprises a terminal end face 28*a* configured to receive a portion of bushing 80*a* therein. Specifically, a first portion of bushing 80*a* is configured to be coupled with drug delivery tube 110, such as discussed above, and a second portion of bushing 80*a* is configured to be coupled with (e.g., inserted into) an enlarged dispersing opening 30*a* of dispersing stem 20*a* of blinding tube 12*a*. Similar to blinding tube assembly 10, end face 140 of drug delivery tube 110 is not visible through dispersing opening 30*a* from outside the blinding tube 12*a* when drug delivery tube 110 is fitted within blinding tube 12*a*. However, flange 94*a* of bushing 80*a* is visible through dispersing opening 30*a* from outside of blinding tube 12*a*.

Figure 9:
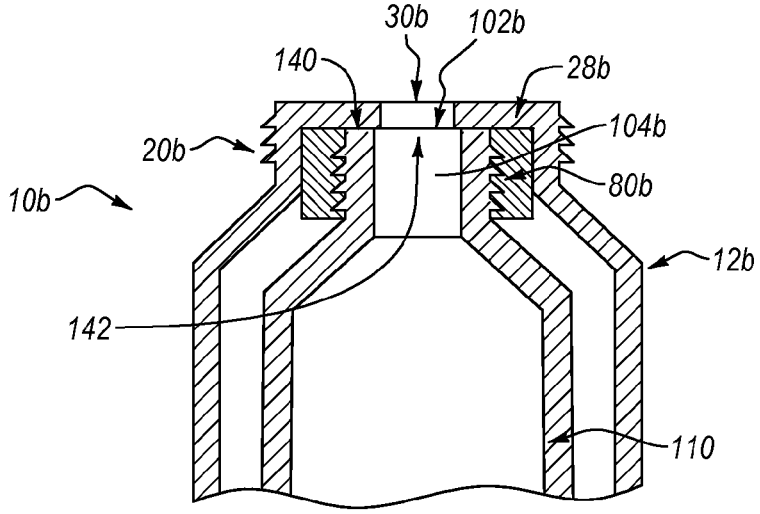
FIG. 9 is a cross-sectional top view of another alternative embodiment of a blinding tube assembly incorporating features of the present invention.

FIG. 9 illustrates a blinding tube assembly 10*b* comprising blinding tube 12*b* having a bushing 80*b* and drug delivery 110 disposed therein. In contrast to bushing 80 (FIG. 6), bushing 80*b* does not include a flange (see flange 94; FIG. 6) configured to cover end face 140 of drug delivery tube 110. Instead, bushing 80*b* has a throughway 104*b* with a substantially constant diameter extending the full length of bushing 80*b* so that terminal end face 140 of drug delivery tube 110 is not covered by bushing 80*b*. Rather, bushing 80*b* is configured to be coupled with drug delivery tube 110 and fitted within dispersing stem 20 of blinding tube 12*b*. In turn, terminal end face 28*b* of blinding tube 12*b* is configured to cover end face 140 of drug delivery tube 110 such that end face 140 is not visible through dispersing opening 30*b* from outside the blinding tube 12*b* when drug delivery tube 110 is fitted within blinding tube 12*b*. Bushing 80*a* is also not visible through dispersing opening 30*b* from outside the blinding tube 12*b*.

Figure 10:
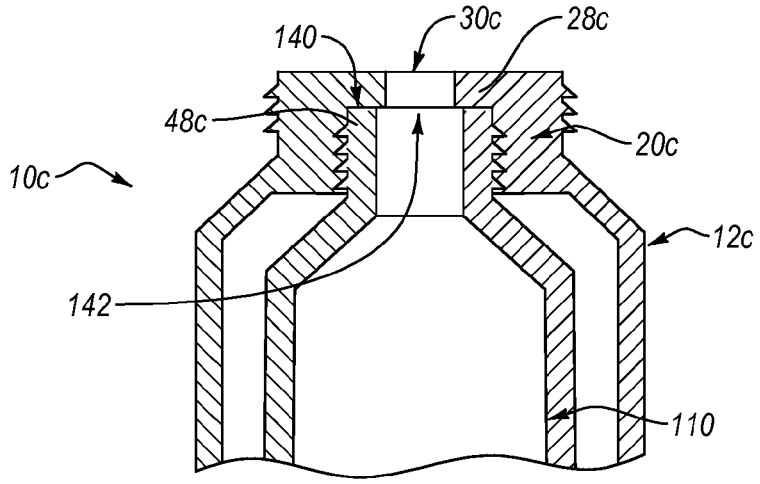
FIG. 10 is a cross-sectional top view of another alternative embodiment of a blinding tube assembly incorporating features of the present invention.

FIG. 10 illustrates a blinding tube assembly 10*c* comprising blinding tube 12*c* having a drug delivery tube 110 disposed therein. In contrast to blinding tube assembly 10 (FIGS. 7B-7C), blinding tube assembly 10*c* does not include a bushing. Rather, blinding tube 12*c* has a channel 48*c* that is configured to directly receive and couple with dispensing stem 120 of drug delivery tube 110. End face 140 of drug delivery tube 110 is covered by a terminal end face 28*c* of blinding tube 12*c* so that end face 140 of drug delivery tube 110 is not visible through dispersing opening 30*c* from outside the blinding tube 12*c*.

Figure 11A:
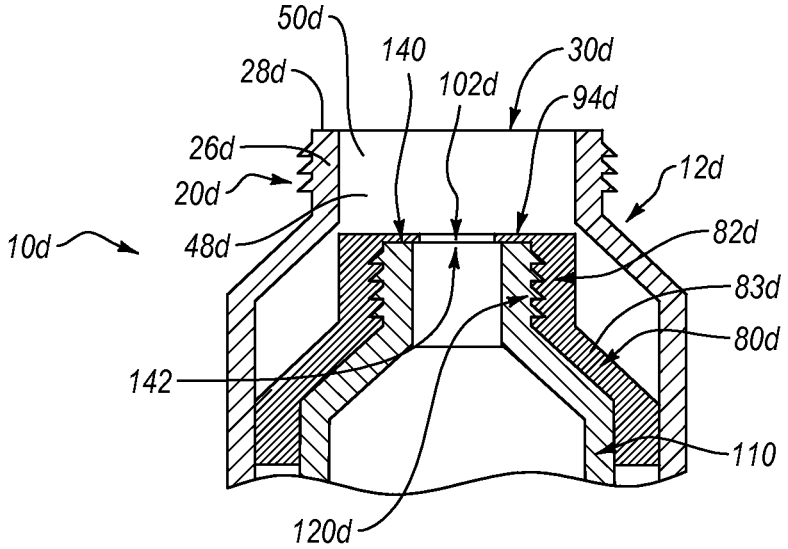
FIG. 11A is a cross-sectional top view of another alternative embodiment of a blinding tube assembly incorporating features of the present invention partially advanced.
Figure 11B:
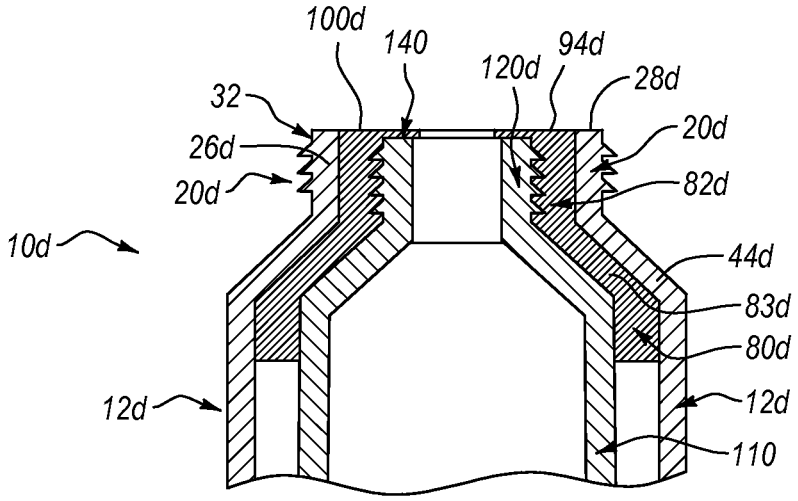
FIG. 11B is a cross-sectional top view of the blinding tube assembly depicted in FIG. 11A fully advanced.

FIGS. 11A and 11B illustrate a blinding tube assembly 10*d* comprising a blinding tube 12*d* having a bushing 80*d* and drug delivery tube 110 disposed therein. In contrast to blinding tube 12 (FIGS. 7B-7C), terminal end face 28*d* of blinding tube 12*d* does not extend radially inward from annular sidewall 26*d* of dispersing stem 20*d*. Instead, dispersing opening 30*d* is the same diameter as channel 48*d* so that passage 50*d* has a substantially constant diameter extending along the full length dispensing stem 20*d* that is configured to receive a portion of bushing 80*d* therein. In this embodiment, terminal end face 28 does not cover, block or stop bushing 80*d*. Thus, outer surface 100*d* of flange 94*d* of bushing 80*d* is received and openly exposed within passage 50*d*.

Bushing 80*d* has cavity 92*d* configured to receive dispensing stem 120 of drug delivery tube 120 and flange 94*d* that is configured to cover end face 140 of drug delivery tube 110. In contrast to bushing 80 (FIGS. 7B-7C), however, bushing 80*d* comprises a tubular body 82*d* having a shoulder element 83*d* configured to abut annular shoulder 44*d* of blinding tube 12*d*. Accordingly, shoulder 44*d* of blinding tube 12*d* stops the progression of drug delivery tube 110 by interacting with shoulder element 83*d* of bushing 80*d*. Thus, a first portion of bushing 80*d* is configured to be coupled with drug delivery tube 110, a second portion of bushing 80*d* is configured to be inserted into passage 50*d* of blinding tube 12*d*, and a third portion of bushing 80*d* is configured to interact with annular shoulder 44*d* of blinding tube 12*d* to stop the progression of drug delivery tube 110. Similar to blinding tube assembly 10 (FIGS. 7B-7C), because of flange 94*d* of bushing 80*d*, end face 140 of drug delivery tube 110 is not visible through dispersing opening 30*d* from outside blinding tube 12*d* when drug delivery tube 110 is fitted within blinding tube 12*d*. As such, the entire exterior surface of drug delivery tube 110 is covered by blinding tube 12*d* and bushing 80*d*. However, flange 94*d* of bushing 80*a* is visible through passage 50*d* from outside blinding tube 12*d*.

Figure 12:
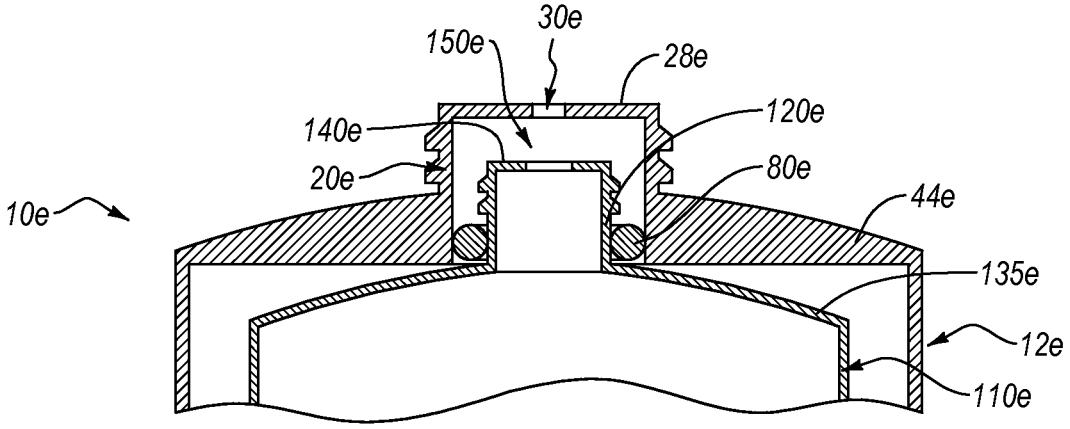
FIG. 12 is a cross-sectional top view of another alternative embodiment of a blinding tube assembly incorporating features of the present invention.

FIG. 12 illustrates a blinding tube assembly 10*e* comprising a blinding tube 12*e* having a bushing 80*e* and drug delivery tube 110*e* disposed therein. Bushing 80*e* can comprise an annular gasket, an 0-ring or other annular seal. Accordingly, those skilled in the art will appreciate that various embodiments of bushing 80 can be configured differently in accordance with the configuration of the particular blinding tube assembly 10 in which it is included. Bushing 80*e* is disposed and forms a seal between tubular dispensing stem 120*e* of drug delivery tube 110*e* and the interior surface of dispersing stem 20*e*. Accordingly, bushing 80*e* functions in part to secure dispensing stem 120*e* within dispersing stem 20*e* of blinding tube 12*e*. Furthermore, shoulder 135*e* of drug delivery tube 110*e* can at least partially abut shoulder 44*e* of blinding tube 12*e* to stop the progression of drug delivery tube 110*e* within blinding tube 12*e*. In at least one embodiment, a gap 150*e* can be disposed between end face 140*e* of drug delivery tube 110*e* and end face 28*e* of blinding tube 12*e*. In the depicted embodiment, end face 140*e* of drug delivery tube 110*e* extends radially inward. This configuration of drug delivery tube can be used with all embodiments of the present invention but is not required. In an alternative embodiment, end face 140 of drug delivery tube 110*e* could abut the interior surface of end face 28*e* of blinding tube 12*e*. This embodiment still achieves covering all or substantially all of the exterior surface of drug delivery tube 110*e*.

Figure 13:
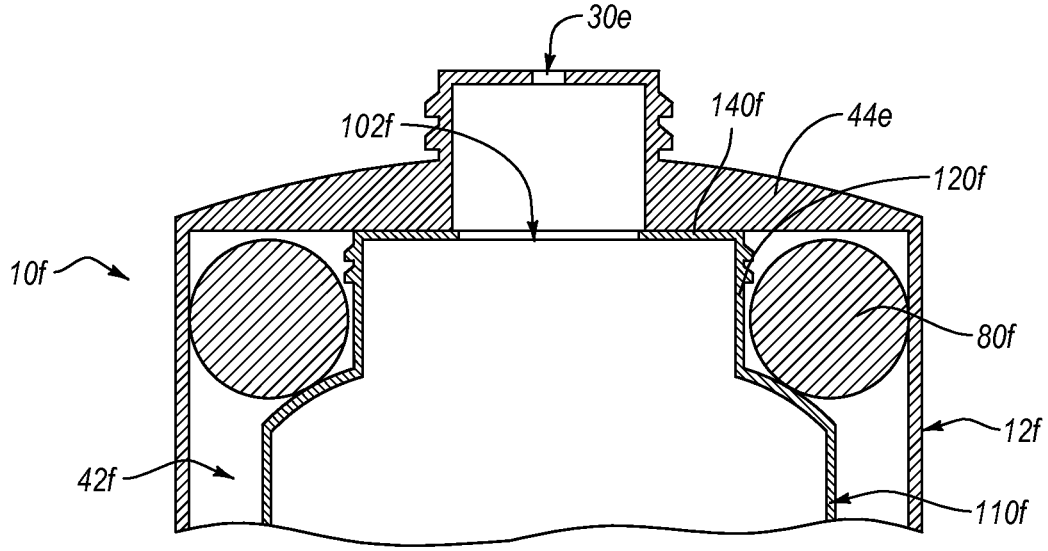
FIG. 13 is a cross-sectional top view of another alternative embodiment of a blinding tube assembly incorporating features of the present invention.

FIG. 13 illustrates a blinding tube assembly 10*f* comprising blinding tube 12*f* having a bushing 80*f* and a drug delivery tube 110*f* disposed therein. In contrast to bushing 80*e* (FIG. 12), bushing 80*f* can be configured to secure dispensing stem 120*f* of drug delivery tube 110*f* within compartment 42*f* of blinding tube 12*f* (e.g., instead of within dispersing stem 20*f* thereof). End face 140*f* of drug delivery tube 110*f* can abut annular shoulder 44*f* of blinding tube 12*f* to stop the progression of drug delivery tube 110*f* within blinding tube 12*f*. Drug delivery tube 110*f* can have a transfer opening 102*f* sufficiently large to conceal end face 140*f* (e.g., ensuring that drug delivery tube 110*f* and/or end face 140*f* are not visible through dispersing opening 30*f* from outside the blinding tube 12*f* when drug delivery tube 110*f* is fitted within blinding tube 12*f*).

Figure 14A:
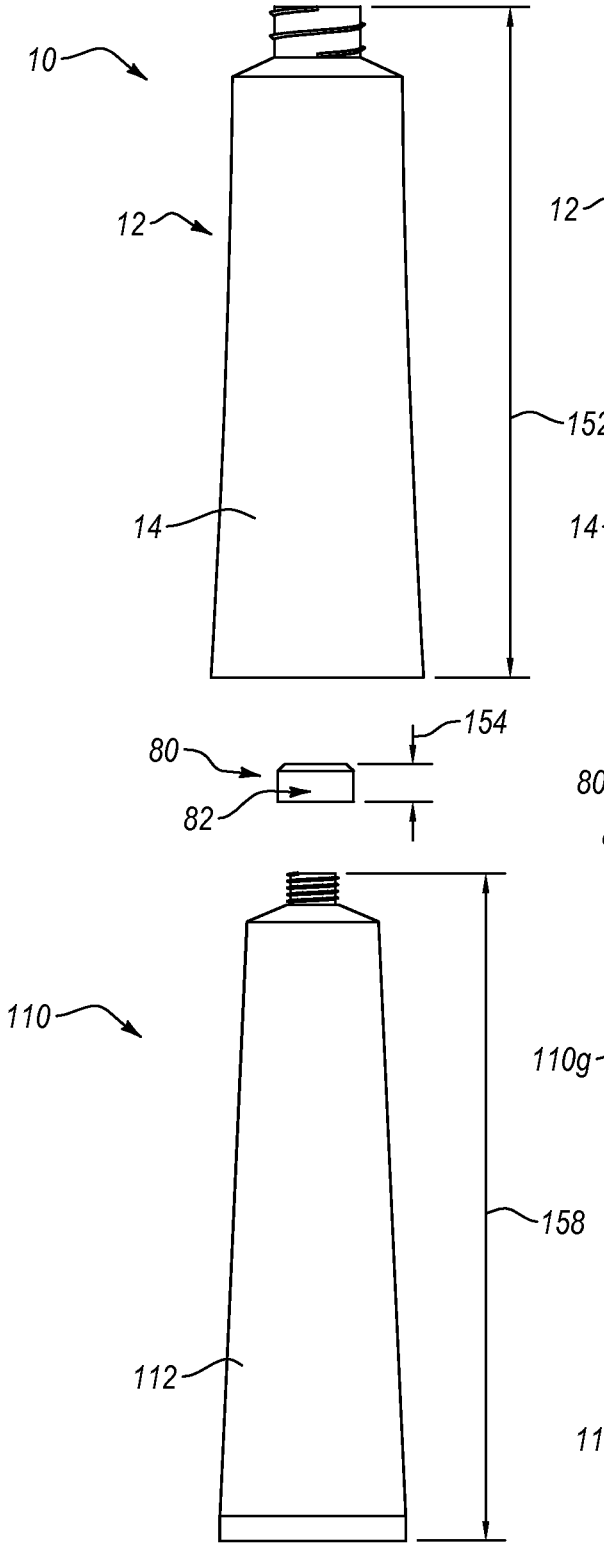
FIGS. 14A and 14B are top plan views of comparable blinding tube assemblies having differently-sized drug delivery tubes and bushings.
Figure 14B:
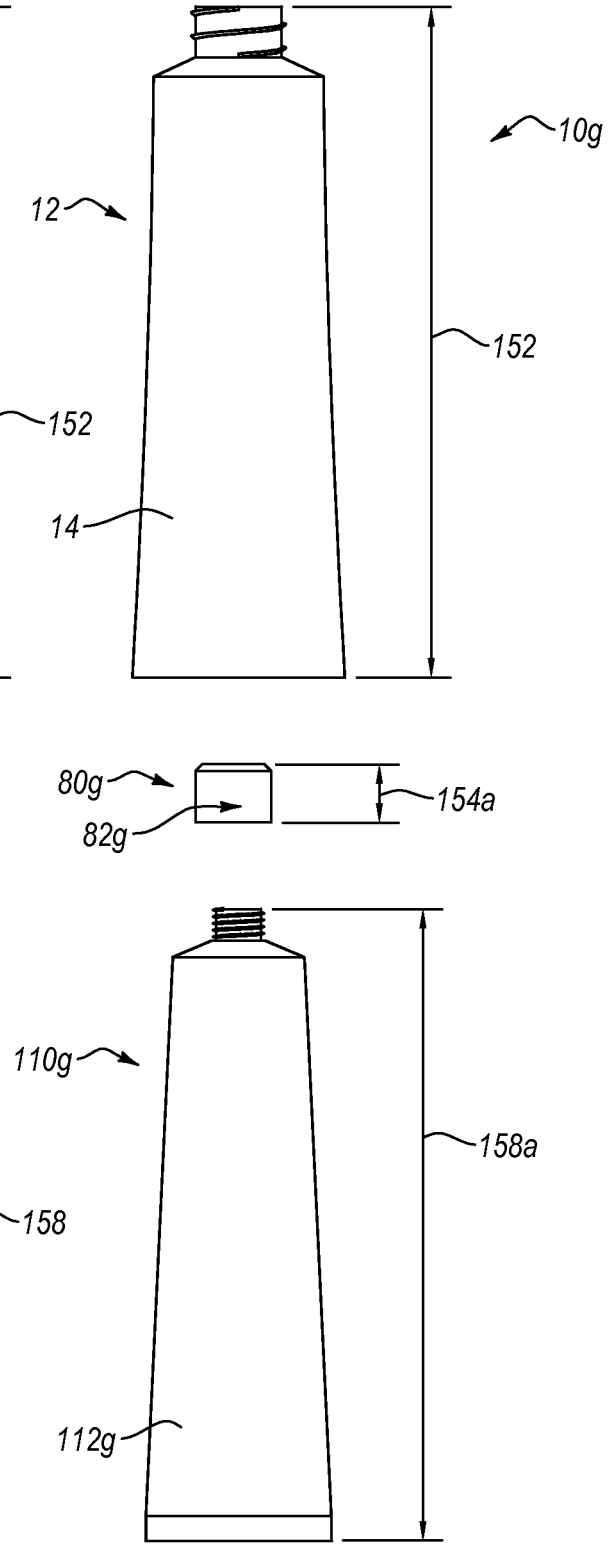

FIGS. 14A and 14B illustrate a useful design feature of two comparable embodiments of the present disclosure. In particular, FIGS. 14A and 14B illustrate how the same size blinding tube 12 can accommodate multiple sizes of drug delivery tube 110. For instance, FIG. 14A illustrates blinding tube assembly 10 having blinding tube 12, bushing 80, and drug delivery tube 110 as described above. Blinding tube 12 has a length 152, bushing 80 has a length 154, and drug delivery tube 110 has a length 158. Length 154 of bushing 80 is configured to accommodate and/or form a suitable fit for drug delivery tube 110 within blinding tube 12. For instance, length 154 of bushing 80 allows for complete insertion of drug delivery tube 110 into sleeve 14 of blinding tube 12 but without a significant excess of wasted space therein.

FIG. 14B, on the other hand, illustrates a bushing 80*g* having a length 154*a* and a drug delivery tube 110*g* having a length 158*a*. Length 158*a* of drug delivery tube 110*g* is shorter than length 158 of drug delivery tube 110, and length 154*a* of bushing 80*g* is longer than length 154 of bushing 80. In particular, the difference between length 154 and 154*a* is substantially similar or identical to the difference between length 158 and length 158*a*. Accordingly, given a standard size or measurement for length 152 of blinding tube 12, the size or length 154 of bushing 80 can be altered to accommodate various sizes or lengths 158 of drug delivery tube 110.

Those skilled in the art will appreciate that drug delivery tubes 110 can be configured in a variety of sizes as determined by the manufacturer. By using different sized bushings, embodiments of the present invention can produce a plurality of blinding tubes having the same size and configuration that house drug delivery tubes having two or more different sizes and/or configurations. As a result, the participants and technicians remain blind as to the size and configuration of the drug delivery tubes. Embodiments of the present disclosure can also accommodate a wide variety of drug delivery tube sizes by providing a variety of different sizes for blinding tube 12 and/or tubular sleeve 14 thereof, as well as bushing 80 and/or tubular body 82 thereof.

Blinding tube 12 can also be configured in any suitable color or shape. In a preferred embodiment, blinding tube 12 is opaque such that drug delivery tube 110 disposed therein is not visible through sleeve 14. Blinding tube 12 can also be configured to reduce the perceptibility of drug delivery tube 110 disposed therein. For instance, sleeve 14 of blinding tube 12 can comprise a flexible material adapted to conform to the shape of drug delivery tube 110 or tubular body 112 thereof.

A variety of connections have been described herein. For instance, various components of blinding tube assembly 10 can be connected via threads. Those skilled in the art will appreciate, however, that other attachment mechanisms are also contemplated herein. For instance, components can be coupled together via a snapped-fit, pressure-fit, lock-fit, or any other suitable mechanism without departing from the scope of this disclosure.

The blinding tube assemblies described herein can have a variety of uses. For instance, blinding tube assembly 10 can be adapted for use in double-blinded or other clinical trials. In some embodiments, blinding tube assembly 10 can (entirely) mask of the difference between two different drug delivery tubes 110. One such drug delivery tube may have an active drug disposed therein (e.g., in liquid or other form). Other drug delivery tubes may have a control substance, comparable drug, or identical drug disposed therein. Regardless, the drug administering technician or recipient is blind as to the identity or identifying characteristics of the drug or drug delivery tube.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A blinding tube assembly for concealing a drug delivery tube having a tubular dispensing stem, the assembly comprising:

a blinding tube comprising:

a tubular sleeve having a first end with an access opening formed thereat and an opposing second end, the sleeve having an interior surface at least partially bounding a compartment; and a tubular dispersing stem projecting from the second end of the tubular sleeve, the dispersing stem bounding a passage extending therethrough; and a tubular bushing having a first end configured to be received within the passage of the dispersing stem and having an interior surface that bounds a throughway, the throughway being configured to receive the dispensing stem of the drug delivery tube such that when the drug delivery tube is received within the compartment of the blinding tube, the dispensing stem of the drug delivery tube can be fluid coupled to the dispersing stem of the blinding tube through the bushing, wherein the bushing comprises: a tubular body that bounds a cavity; and an annular flange radially inwardly extending from the tubular body so as to cover a portion of the cavity, the flange encircling a transfer opening that communicates with the cavity, the throughway of the bushing comprising the cavity and the transfer opening.

2. The blinding tube assembly of claim 1, wherein the dispersing stem of the blinding tube comprises:

an annular sidewall having an interior surface extending between a first end and an opposing second end, the first end being coupled with the tubular sleeve, the interior surface at least partially bounding a channel; and a terminal end face disposed at the second end of the sidewall so as to cover a portion of the channel, a dispersing opening extending through the terminal end face so as to communicate with the channel, the passage of the dispersing stem comprising the channel and the dispersing opening.

3. The blinding tube assembly of claim 2, wherein the dispersing opening has a diameter that is smaller than a diameter of the transfer opening.

4. The blinding tube assembly of claim 1, further comprising a cap removably connected to the dispersing stem of the blinding tube.

5. A blinding tube system comprising:

a blinding tube comprising:

a tubular sleeve having an interior surface at least partially bounding a compartment and that extends between a first end and an opposing second end;

a dispersing stem projecting from the second end of the tubular sleeve, the dispersing stem bounding a passage extending therethrough and communicating with the compartment; and a cap removably connected to the dispersing stem; and a drug delivery tube housing a dosage and having a dispensing stem through which the dosage can pass, the dispensing stem terminating at a terminal end face, the drug delivery tube being received within the compartment of the blinding tube with the dispensing stem of the drug delivery tube being coupled with the dispersing stem of the blinding tube; and a tubular bushing disposed between the dispensing stem of the drug delivery tube and the dispersing stem of the blinding tube, the tubular bushing comprising: a tubular body that bounds a cavity, the dispensing stem of the drug delivery tube being received within the cavity; and an annular flange radially inwardly extending from the tubular body so as to cover the terminal end face of the dispensing stem.

6. The blinding tube system of claim 5, wherein the terminal end face of the dispensing stem is not visible through the dispersing opening of the dispersing stem from outside the blinding tube.

7. The blinding tube system of claim 5, wherein the dispersing stem of the blinding tube comprises:

an annular sidewall having an interior surface extending between a first end and an opposing second end, the first end being coupled with the tubular sleeve, the interior surface at least partially bounding a channel, the dispensing stem of the drug delivery tube being received within the channel; and a terminal end face disposed at the second end of the sidewall so as to cover a portion of the channel, a dispersing opening extending through the terminal end face so as to communicate with channel, the passage of the dispersing stem comprising the channel and the dispersing opening.

8. The blinding tube system of claim 7, wherein the dispensing stem of the drug delivery tube has a dispensing opening extending therethrough, the dispensing opening having a diameter that is larger than a diameter of the dispersing opening of the blinding tube.

9. The blinding tube system of claim 7, further comprising a bushing encircling the dispensing stem of the drug delivery tube and being received within the channel of the dispersing stem.

10. The blinding tube system of claim 9, wherein the bushing comprises:

a tubular body that bounds a cavity, the dispensing stem of the drug delivery tube being received within the cavity; and an annular flange radially inwardly extending from the tubular body so as to cover the terminal end face of the dispensing stem, the flange encircling a transfer opening that communicates with the cavity.

11. A method of assembling a blinding tube system, comprising:

inserting a delivery end of a drug delivery tube into a compartment of a blinding tube through an access opening at a first end of the blinding tube, the drug delivery tube housing a dosage and having a tubular dispensing stem through which the dosage can pass, a bushing has a tubular body that bounds a cavity in which the dispensing stem of the drug delivery tube is received, the bushing having an annular flange radially inwardly extending from the tubular body so as to cover a terminal end face of the dispensing stem of the drug delivery tube, the blinding tube having a second end opposite the first end with a dispersing stem projecting therefrom;

advancing the drug delivery tube within the compartment of the blinding tube until the bushing couples with the dispersing stem of the blinding tube; and closing the access opening at the first end of the blinding tube so that the drug delivery tube is concealed within the blinding tube.

12. The method of claim 11, further comprising:

the dispensing stem of the drug delivery tube terminating at a terminal end face; and the dispensing stem of the blinding tube having a passage extending therethrough, the bushing coupling with the dispersing stem so that an end face of the dispensing stem is not visible through the passage of dispersing stem from outside the blinding tube.

13. The method of claim 11, wherein the step of closing the access opening at the first end of the blinding tube comprises crimping or rolling the first end of the blinding tube.

14. The method of claim 11, further comprising threadedly coupling a cap onto the dispersing stem of the blinding tube.

* * * * *